US006092983A

United States Patent [19]

Tomita et al.

[11] Patent Number: 6,092,983

[45] Date of Patent: Jul. 25, 2000

[54] GAS TURBINE COOLING STATIONARY BLADE

[75] Inventors: Yasuoki Tomita; Sunao Aoki; Kiyoshi Suenaga; Tatsuo Ishiguro, all of Hyogo-ken, Japan

[73] Assignee: Mitsubishi Heavy Industries, Ltd., Tokyo, Japan

[21] Appl. No.: 09/202,594

[22] PCT Filed: Apr. 28, 1998

[86] PCT No.: PCT/JP98/01958

§ 371 Date: Dec. 17, 1998

§ 102(e) Date: Dec. 17, 1998

[87] PCT Pub. No.: WO98/50684

PCT Pub. Date: Nov. 12, 1998

[30] Foreign Application Priority Data

May 1, 1997 [JP] Japan ..... 9-113842
May 1, 1997 [JP] Japan ..... 9-113845

[51] Int. Cl.[7] ..... F01D 9/04

[52] U.S. Cl. ..... 415/115; 416/96 R; 416/97 R; 416/95

[58] Field of Search ..... 415/114, 115, 415/116; 416/96 R, 97 R, 95, 97 A, 96 A

[56] References Cited

U.S. PATENT DOCUMENTS 4,142,824 3/1979 Andersen ..... 415/115
4,948,338 8/1990 Wickerson ..... 416/190
5,634,766 6/1997 Cunha et al. ..... 415/115

FOREIGN PATENT DOCUMENTS 4-311604 11/1992 Japan .
5-65802 3/1993 Japan .
6-93801 4/1994 Japan .
6-257405 9/1994 Japan .
8-177406 7/1996 Japan .

*Primary Examiner*—Edward K. Look
*Assistant Examiner*—Richard Woo
*Attorney, Agent, or Firm*—Sughrue, Mion, Zinn, Macpeak & Seas, PLLC

[57] ABSTRACT

In a cooled stationary blade assembly for a gas turbine, an interior of a blade and an inner shroud are cooled by steam to eliminate the use of air cooling. Steam passages 33A, 33B, 33C, 33D, 33E and 33F are provided in the stationary blade 30. The cooling steam 39 is introduced from the steam passage 33A on the front edge side through an outer shroud and passes, in order, through the steam passages 33B, 33C, 33D, and 33E to flow into the steam passage 33F at the rear edge side to cool the interior of the blade, and is recovered through the outer shroud from the upper portion of the steam passage 33F. A portion of the steam from the steam passage 33A is introduced into the inner shroud 31, enters to steam passages 20 from a steam introduction passage 22, branches to the right and left through both end portions, and flows out into the steam passage 33F at the rear edge from a steam discharge passage 21. Not only the interior of the blade, but also the interior of the inner shroud 31 is cooled by the steam so that the cooling air is dispensed with.

5 Claims, 4 Drawing Sheets

GAS TURBINE COOLING STATIONARY BLADE

BACKGROUND OF THE INVENTION

1. Technical Field of The Invention

The present invention relates to a steam cooled stationary blade for a gas turbine, and more particularly to a cooled stationary blade for a gas turbine for steam cooling both an inner shroud and the blade.

2. Description of The Related Art:

FIG. 5 shows a typical conventional air cooled type gas turbine stationary blade. In this drawing, numeral 40 denotes a stationary blade, numeral 41 denotes an outer shroud and numeral 42 denotes an inner shroud. Reference characters 43A, 43B, 43C, 43D and 43E denote respective air passages. Numeral 45 denotes a rear edge of the blade. Numeral 44 denotes air blowout holes at the rear edge. Reference numeral 46 denotes turbulators provided in an inner wall of each air passage 43A to 43E for enhancing heat transmission by distributing the air flow.

In this air cooled type stationary blade, the cooling air 47 is introduced from the outer shroud 41 to the air passage 43A and flows to a base portion (at the inner shroud side). The cooling air is introduced from the base portion into the next air passage 43B. The cooling air flows to an upper end (at the outer shroud side) and into the next air passage 43C. The cooling air flows in the same way through the air passages 43D and 43E, in that order, to thereby cool the blade. Then, in the air passage 43E, the cooling air is blownout from the air blowout holes 44 of the rear edge 45, and at the same time, the rest of the air flows out from the lower side of the inner shroud 42.

In the above air cooled type stationary blade, a serpentine cooling path is formed by the air passages 43A to 43E to cool the blade by means of the cooling air flowing through the path. However, there is no consideration of the cooling effect on the shrouds.

FIG. 4 shows an example of a cooled stationary blade in which the blade is cooled by steam and the shrouds are cooled by air. The steam cooling system used in this stationary blade has not yet been put into practical use. However, it is a technique which has been researched by the present applicant. In the drawing, reference numeral 30 denotes the stationary blade, from which the outer shroud at an upper portion thereof has been omitted, and in which a portion of the blade is shown. Numeral 31 denotes the inner shroud. Reference numerals 33A, 33B, 33C, 33D, 33E and 33F denote steam passages of the respective interiors of the stationary blade.

In the thus constructed stationary blade, the cooling steam 39 is introduced from a front edge portion of the outer shroud (not shown) to the steam passage 33A and from a base portion thereof (inner shroud side) into the steam passage 33B. The cooling steam flows from an upper portion of the steam passage 33B (at the outer shroud side) into the next steam passage 33C and flows through the steam passages 33D and 33E in a similar manner. The steam flows from the base portion side of the steam passage 33E into the steam passage 33F on the rear edge side to cool the interior of the blade. Thereafter, the steam is recovered from the steam recovery port of the outer shroud.

On the other hand, the inner shroud 31 is cooled by cooling air.

The cooling air 37, introduced from the lower portion of the inner shroud 31, is introduced into air cooling passages in the interior of the inner shroud 31 from one end thereof. The air flows from one side to the other within these air cooling passages to cool the entire inner shroud 31 and is discharged from the air blowout holes 38 on the other side to air cool the entire blade.

As described above, in the conventional gas turbine stationary blade shown in FIG. 5, the air cooling system is mainly used to cool the blade, but not to cool the inner shroud at all. Also, in the air cooling system shown in FIG. 4, in an example made by the present applicant, the cooling air is introduced into the air cooling passages within the inner shroud 31 and flows from one side to the other in the inner shroud to cool the surface of the shroud from the interior. The air flows out from the air blowout holes 38 on the other side. Furthermore, although not shown in this case, a recess is formed in the inner surface of the inner shroud 31. An impingement plate is provided in parallel with the inner surface of the inner shroud. Another (method) also being developed by the present applicant is one in which the cooling air 37 fed from the lower portion impinges on the impingement plate and is blownout from a number of holes so that the interior of the shroud is uniformly cooled by the air.

However, in the air cooling system shown in FIG. 5 described above, a large amount of air is consumed for cooling and the air that has been used for cooling is discharged to the combustion gas passage. Consequently, the system suffers from a problem in that a relatively large amount of power is consumed by a compressor or a cooler. Also, since the air that has been used for cooling is discharged into the combustion gas passage, the cooling air is mixed with the combustion gas which lowers the gas temperature resulting in a reduction of turbine efficiency.

On the other hand, in the steam cooling system for the blade shown in FIG. 4, since the blade is cooled by using steam and the steam which has been used for cooling is recovered and returned to the steam feed source, it is possible to utilize the steam effectively. However, only the blade is cooled by the steam, and the air cooling system is used for the inner shroud. The air that has been used for cooling the inner shroud is discharged into the main stream of the combustion gas flowing through the gas turbine. Accordingly, compared with the system of cooling the blade with air as shown in FIG. 5, it is possible to conserve and reduce the amount of cooling air. However, in any case, the turbine efficiency is lowered because the cooling air is needed and the temperature of the combustion gas is lowered by the mixture of the air into the combustion gas.

OBJECT OF THE INVENTION

Accordingly, in order to solve the above-noted problems, a primary object of the present invention is to provide a gas turbine cooled stationary blade in which not only cooling of an interior of a blade, but also cooling of an inner shroud is performed by steam cooling, and steam that has been used for cooling is completely recovered and returned to a steam feed source for effective utilization without the necessity of cooling air to thereby enhance the efficiency of the turbine.

Also, another object of the present invention is to provide a gas turbine cooled stationary blade in which the structure of a steam passage for cooling the inner shroud is simplified so that machining and assembly of the blade are also improved.

SUMMARY OF THE INVENTION

In order to attain these objects, the following embodiments (1) to (5) are provided, respectively.

(1) A cooled stationary blade assembly for a gas turbine according to the present invention is characterized by comprising an outer shroud, an inner shroud, a stationary blade provided between the outer and inner shrouds with a front edge and a rear edge, a first steam cooling means provided in an interior of the stationary blade for cooling steam, and a second steam cooling means provided in the inner shroud and communicated with the first steam cooling means in order to flow a portion of the cooling steam.

In the above-described embodiment (1) of the present invention, the interior of the blade is cooled with the steam by the first and second steam cooling means, and at the same time, the inner shroud may also be cooled with steam, the conventional cooling air is dispensed with, the power consumption of the compressor or the cooler may be conserved, and the cooling air is not discharged into the combustion gas passage. As a result, the temperature of the combustion gas is not lowered and a reduction in turbine efficiency is prevented.

(2) The cooled stationary blade assembly for a gas turbine according to the above-described embodiment (1) is characterized in that the first steam cooling means and the second steam cooling means are communicated with each other on the front edge side and on the rear edge side of the stationary blade, a portion of the cooling steam is introduced from the first steam cooling means to the second steam cooling means on the front edge side of the stationary blade, and the cooling steam that passes through the second steam cooling means is returned to the first steam cooling means on the rear edge side of the stationary blade.

In the above-described embodiment (2) of the present invention, it is possible to effectively utilize the steam because the portion of the cooling steam that has been introduced to the second steam cooling means of the inner shroud from the front edge is recovered from the rear edge thereof at the first steam cooling means.

(3) The cooled stationary blade assembly for a gas turbine according to the above-described embodiment (2) is characterized in that the first steam cooling means is first steam passages, the cooling steam is introduced into the steam passages on the front edge side of the stationary blade through the outer shroud, and the cooling steam flows out of the steam passages on the rear edge side through the outer shroud.

In the above-described embodiment (3) of the present invention, since the cooling steam flows through the steam passage, it is possible to effectively cool the blade. The cooling steam that has been introduced into the blade is used to cool the blade and the inner shroud so that its temperature increases. The steam is recovered through the outer shroud and returned to the steam feed source. The steam is effectively utilized so the efficiency of the turbine is increased.

(4) The cooled stationary blade assembly for a gas turbine according to the above-described embodiment (2) or (3) is characterized in that the second steam cooling means is a second steam passage and is arranged in the vicinity of an end portion of the inner shroud.

In the above-described embodiment (4), the cooling steam flows through the periphery of the inner shroud to effectively cool the inner shroud.

(5) The cooled stationary blade assembly for a gas turbine according to the above-described embodiment (1) is characterized in that the second steam cooling means of the inner shroud is composed of a groove provided along a peripheral side surface of the inner shroud and a side plate for covering the groove.

In the above-described embodiment (5), the second steam cooling means is thus constructed so that formation at the end portion of the inner shroud is facilitated.

DESCRIPTION OF THF PREFERRED EMBODIMENTS

Figure 1:
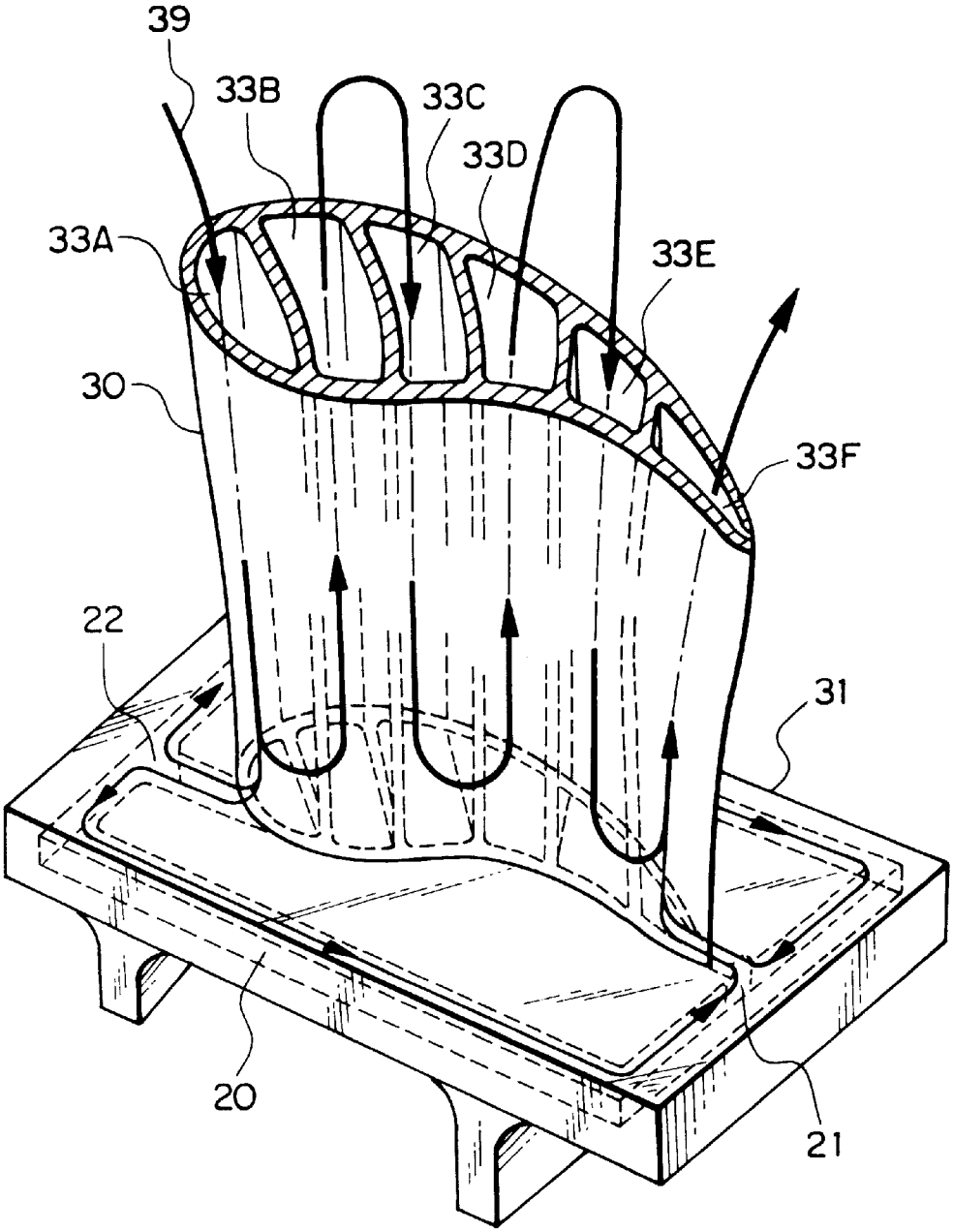
FIG. 1 is a schematic view showing a cooled stationary blade for a gas turbine in accordance with an embodiment of the present invention.

An embodiment of the invention currently considered preferable and another embodiment that may be substituted therefor will now be described in detail with reference to the accompanying drawings. In the following description, the same reference numerals are used for like components throughout the drawings. Also, in the following descriptions, the terms "right", "left", "upper" and "lower" are used for the sake of convenience, and these terms should not be interpreted in any limiting manner.

Embodiment 1

FIG. 1 is a schematic view of a cooled stationary blade for a gas turbine in accordance with an embodiment of the present invention. In the drawing, reference numerals 31 and 33A to 33F denote components having the same functions as those of the cooled stationary blade for the gas turbine shown in FIG. 4 now being developed by the present applicant, an explanation of which has been given so a detailed explanation will be omitted here. The characteristic portion of the present invention is a cooled stationary blade for a gas turbine which is under development by the present applicant and is further improved, and not only the interior of the blade 30, but also the end portion of the inner shroud 31 is steam-cooled.

Figure 4:
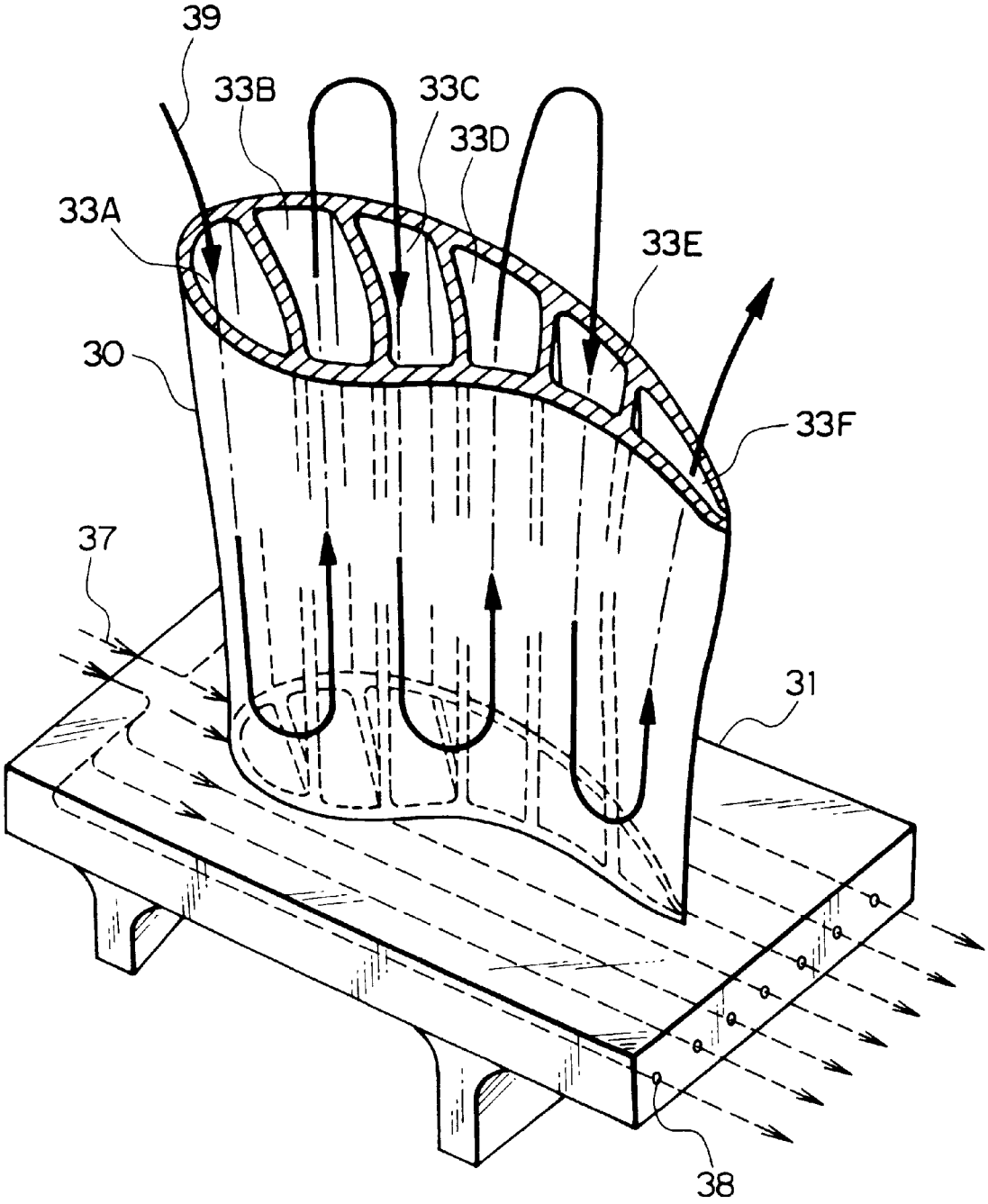
FIG. 4 is a schematic view of a cooled stationary blade of a gas turbine according to an example made by the present applicant concerning the present invention.
Figure 5:
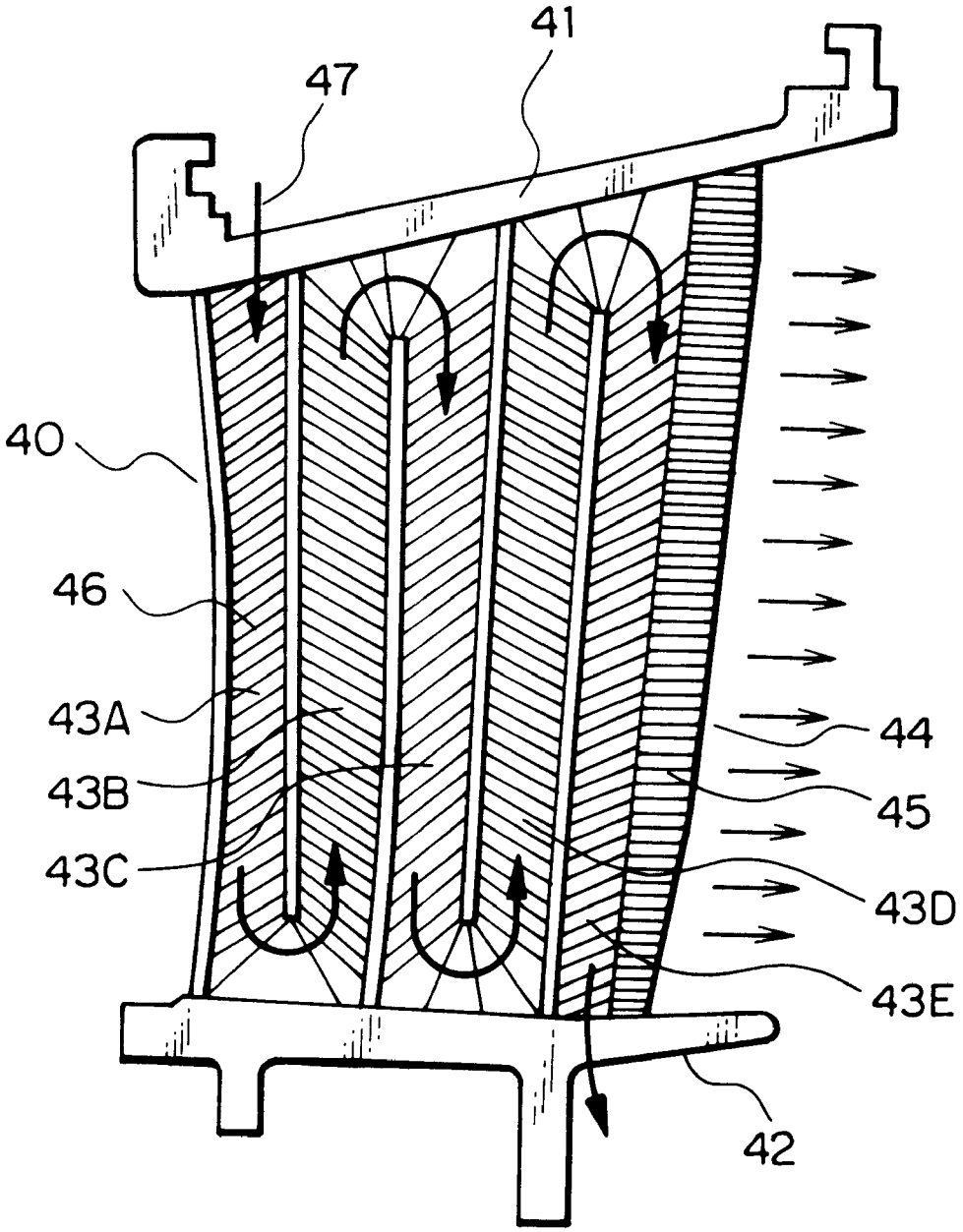
FIG. 5 PRIOR ART
FIG. 5 is an illustration of an interior of a conventional gas turbine stationary blade.

In FIG. 1, the cooling steam 39 is introduced into the steam passage 33A from the outer shroud (not shown) of the front edge side of the stationary blade 30 in the same way as in the example shown in FIG. 4. The steam is introduced from the steam passage 33A to the steam passage 33B to flow to the upper portion thereof (at the outer shroud side) to enter the steam passage 33C. In the same way, the steam flows through the steam passages 33C and 33D and is introduced from the lower portion of the steam passage 33E (on the inner shroud side) to the steam passage 33F of the rear edge of the blade 30. The interior of the blade is cooled by the passage of the steam. The steam is recovered from the steam recovery opening of the outer shroud (not shown) at an upper portion.

On the other hand, a portion of the cooling steam 39 that has been introduced from the steam passage 33A at the front edge is introduced into the inner shroud 31 from the lower portion of the steam passage 33A and flows from the steam introduction passage 22 to the steam passage 20 which is provided in the vicinity of an end portion of the inner shroud 31 and branches to the right and left sides from the steam introduction passage 22. The steam is introduced from both sides to the steam discharge passage 21 on the rear edge side through both end portions. The cooling steam that has been introduced into the steam discharge passage 21 is introduced into the steam passage 33F at the rear edge communicated with the steam discharge passage, and merges with the cooling steam that is introduced into the steam passage 33F through the steam passages 33A to 33E in the interior of the blade. The (combined) steam flows upwardly and is recovered from the steam recovery opening of the outer shroud (not shown). Thus, the cooling steam is used to steam cool the interior of the blade 30. Also, the end portion of the inner shroud 31 is cooled with a portion of the steam, thereby steam cooling the stationary blade as a whole.

Figure 2:
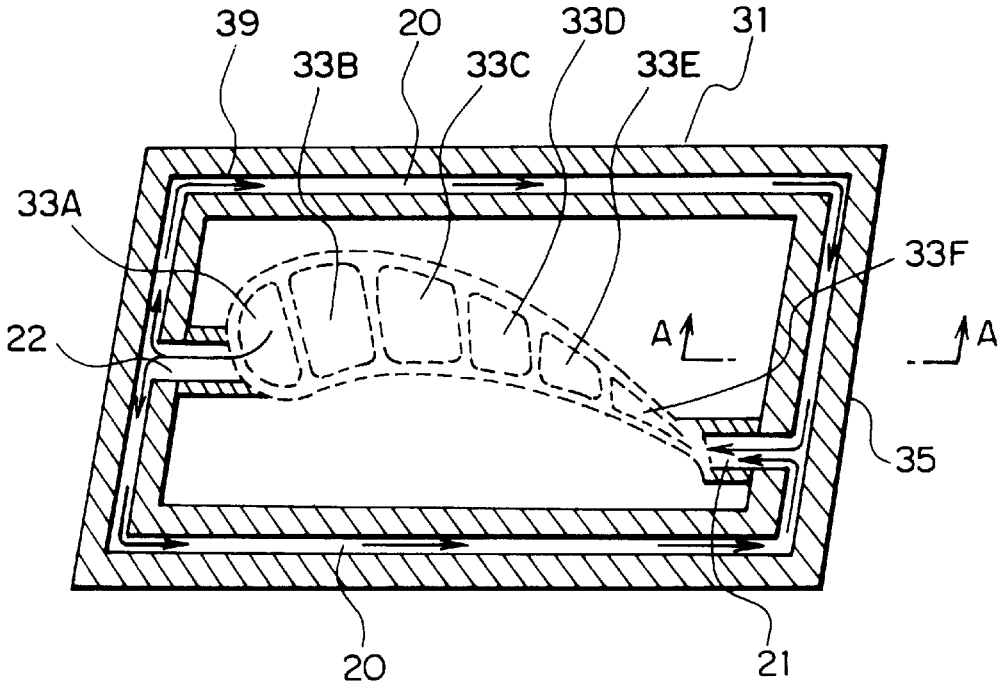
FIG. 2 is a cross-sectional view of an interior of an inner shroud in the cooled stationary blade of the gas turbine according to the embodiment of the present invention.

FIG. 2 is a cross-sectional view showing an interior of the inner shroud 31 of the cooled blade according to the above-described embodiment. In the drawing, the steam passage 20 is provided in a rib 35 provided in the vicinity of the end portion of the inner shroud 31. The steam introduction passage 22 for communicating the steam passage 20 and the steam passage 33A with each other is provided at the front edge side of the blade. Also, the steam discharge passage 21 for communicating the steam passage 33F and the steam passage 20 with each other is provided at the rear edge side of the blade.

The cooling steam is introduced from the steam passage 33A on the front edge side of the stationary blade 30 through the steam introduction passage 22, as indicated by the solid lines in the drawing, to enter the steam passage 20 and is separated to the right and left to pass through both end portions of the inner shroud 31 and flow to the rear edge side of the stationary blade to cool the periphery of the inner shroud 31. The steam is then discharged into the steam passage 33F from the steam discharge passage 21 at the rear edge of the stationary blade.

Figure 3:
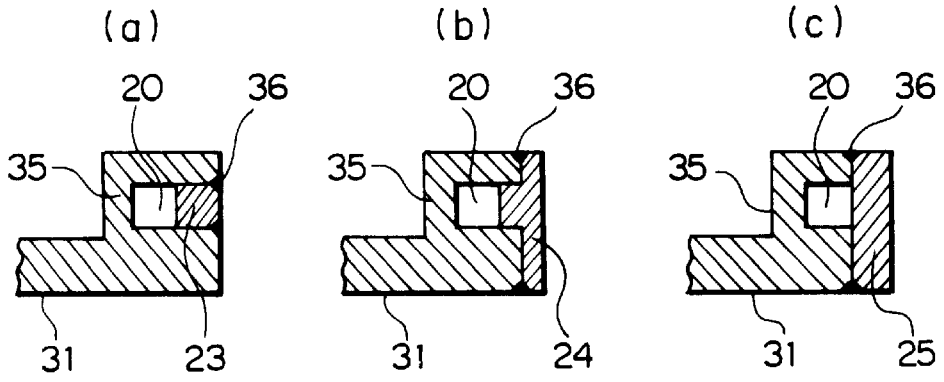
FIG. 3 is cross-sectional views taken along the line A—A of FIG. 2, with portions (a), (b) and (c) each indicating examples of different structures.

FIGS. 3(*a*), (*b*) and (*c*) are cross-sectional views taken along the line A—A of FIG. 2 and show steam passages 20 with different respective structures. In any one of the structures shown in FIGS. 3(*a*), (*b*) and (*c*), a groove is first formed in a rib 35 provided at an end portion of the inner shroud 31. Then, in the structure shown in FIG. 3(*a*), a side plate 23 having a width which is substantially the same as that of the groove is inserted into and fixed to the groove to define the steam passage 20. Also, in the structure shown in FIG. 3(*b*), a side plate 24 having a projection with a width which is substantially the same as that of the groove and having a width which is substantially the same as an end width of the rib 35 and the inner shroud 31 is inserted into and fixed to the groove to define the steam passage 20. Furthermore, in the structure shown in FIG. 3(*c*), a side plate 25 having the same thickness as that of the end portion of the rib 35 and the inner shroud 31 is mounted and fixed so as to cover the entire groove formed in the rib 35 to thereby define the steam passage 20.

Incidentally, after the groove which serves as the steam passage 20 of the inner shroud 31 is covered by a side plate, it is preferable that a linear welding bond, a brazing bond or the like be effected to the contact portion between the groove and the side plate as indicated by reference numeral 36 to avoid steam leakage. Also, any one of these structures may be applied to the cooled stationary blade of the gas turbine according to the present invention. Furthermore, the structure of the steam passage 20 is not limited to these. It is also possible to cut the interior to form an integral structure. Also, the shape is not limited to rectangular, but may be formed round.

According to the above-described embodiment, a structure is provided in which the steam passage 20 is formed at the peripheral portion of the end portion of the inner shroud 31, the steam is introduced from the steam passage 33A at the front edge side of the blade into the steam passage 20 through the steam introduction passage 22, and the steam passes through both side end portions of the inner shroud 31 and flows through the steam discharge passage 21 at the rear edge side of the blade from the steam passage 33F at the rear edge. Accordingly, not only the interior of the stationary blade 30, but also the inner shroud 31 may be cooled by the steam to conserve the cooling air and to reduce the power consumed by the compressor or the cooler.

Furthermore, as the steam which has been used for cooling is recovered, the heat that has been absorbed by the steam due to the cooling effect may be reused in the steam feed source. Also since air is not used, it is possible to considerably enhance the efficiency of the turbine.

The embodiment of the invention, currently considered to be preferable, and another embodiment which may be substituted therefor have been described in detail with reference to the accompanying drawings. However, the present invention is not limited to these embodiments. Those skilled in the art readily understand that various modifications and additions to the gas turbine cooled stationary blade are included in the present invention without departing from the spirit and the scope of the present invention. Also, those skilled in the art may realize these modifications and additions without any difficulty.

What is claimed is:

1. A cooled stationary blade assembly for a gas turbine, comprising:

an outer shroud;

an inner shroud (31);

a stationary blade (30), having a front edge and a rear edge, is provided between said outer shroud and said inner shroud (31);

first steam cooling means (33A to 33F) provided in an interior of said stationary blade which receive cooling steam (39) in a first passage (33A) adjacent to said front edge of said stationary blade and discharges cooling steam (39) only from a last passage (33F) adjacent to said rear edge of said stationary blade; and second steam cooling means (20) provided in the vicinity of an end portion of said inner shroud, wherein said first steam cooling means (33A to 33F) and said second steam cooling means (20) communicate with each other at said first passage (33A) and at said last passage (33F) of said stationary blade, with said first steam cooling means providing a portion of the cooling steam (39) to said second steam cooling means at said first passage (33A) of said stationary blade and said second steam cooling means returning the cooling steam (39) to said first steam cooling means at said last passage (33F) of said stationary blade to recover the cooling steam.

2. The cooled stationary blade assembly for a gas turbine according to claim 1, wherein said first steam cooling means comprises first steam passages (33A to 33F), said cooling steam is introduced into said steam passages on said front edge side of said stationary blade (30) through said outer shroud, and said cooling steam flows out of said steam passages on said rear edge side through said outer shroud.

3. The cooled stationary blade assembly for a gas turbine according to claim 1, wherein said second steam cooling means (20) of said inner shroud (31) is composed of a groove provided along a peripheral side surface of said inner shroud and a side plate for scaling said groove.

4. A cooled stationary blade assembly for a gas turbine, comprising:

an outer shroud;

an inner shroud (31);

a stationary blade (30), having a front edge and a rear edge, positioned between said outer shroud and said inner shroud (31);

first steam cooling passages (33A to 33F) provided in an interior of said stationary blade which receive cooling steam (39) in a first passage (33A) adjacent to said front edge of said stationary blade and discharges cooling steam (39) only from a last passage (33F) adjacent to said rear edge of said stationary blade; and second steam cooling passage (20) provided in the vicinity of an end portion of said inner shroud, wherein said first steam cooling passages (33A to 33F) and said second steam cooling passage (20) communicate with each other at said front edge side and at said rear edge side of said stationary blade, with said first steam cooling passages providing a portion of the cooling steam (39) to said second steam cooling passage at said front edge side of said stationary blade, and said second steam cooling passage returning the cooling steam to said first steam cooling passages at said rear edge side of said stationary blade to recover the cooling steam.

5. The cooled stationary blade assembly for a gas turbine according to claim 4, wherein said second steam cooling passage (20) of said inner shroud (31) comprises a groove provided along a peripheral side surface of said inner shroud and a side plate which seals said groove.

* * * * *